United States Patent [19]

Asbeck et al.

[11] 4,260,686

[45] Apr. 7, 1981

[54] PROCESS FOR THE ENZYMATIC SOFTENING OF FURS

[75] Inventors: Adolf Asbeck, Düsseldorf; Hans F. Pfeiffer, Haan; Juergen Plapper; Rolf Schmid, both of Hilden, all of Fed. Rep. of Germany

[73] Assignee: Henkel Kommanditgesellschaft auf Aktien, Düsseldorf-Holthausen, Fed. Rep. of Germany

[21] Appl. No.: 67,512

[22] Filed: Aug. 17, 1979

[30] Foreign Application Priority Data

Aug. 23, 1978 [DE] Fed. Rep. of Germany ..... 2836824

[51] Int. Cl.[3] ..... C14C 1/00

[52] U.S. Cl. ..... 435/265; 8/94.14

[58] Field of Search ..... 8/94.14; 435/265, 272, 435/939

[56] References Cited

U.S. PATENT DOCUMENTS

| | | | |
|---|---|---|---|
| 3,549,495 | 12/1970 | Monsheimer et al. | 435/265 |
| 3,558,430 | 1/1971 | Monsheimer et al. | 435/265 |
| 4,062,732 | 12/1977 | Lehmann et al. | 435/939 X |

*Primary Examiner*—Thomas G. Wyse

*Attorney, Agent, or Firm*—Hammond & Littell, Weissenberger and Muserlian

[57] ABSTRACT

The present invention concerns a process for the softening of furs while at the same time taking the greatest possible care of the appearance of the hair. The process of this invention comprises contacting a fur with an acid aqueous liquor containing an acid protease from a fungus strain of the genus *Rhizopus rhizopodiformis,* said acid protease being effective in the pH range of from about 2.5 to 6.5.

7 Claims, No Drawings

PROCESS FOR THE ENZYMATIC SOFTENING OF FURS

FIELD OF THE INVENTION

The present invention relates to a process for improving the enzymatic softening of furs by using a special protease effective in the acid pH range.

BACKGROUND OF THE INVENTION

The drying of skins and hides constitutes a fundamental change in the water balance of the proteins which participate in the building-up of the skin. In particular, the protein materials which are located between the collagen fibers and which are water soluble in the natural state, but which are less responsible for the skin structure, are denatured, whereby the collagenous bundles of fibers, responsible for the elasticity and strength of the skin, stick together (agglutinate) and harden. The absorption of water is thereby greatly obstructed after dehydration of the skins.

It is known to soften hides and skins enzymatically in the neutral and slightly alkaline pH ranges by means of enzymatic agents, with and without an additive of wetting agents. The non-structured protein materials which cause the skin fiber network to agglutinate and obstruct the softening process, are decomposed and dissolved out. In this manner, the softening and returning of the hides and skins to the natural swollen state by absorption of water are considerably accelerated.

Processes for the enzymatic softening of furs which are performed by using proteolytic enzymes, have already been described in German Patent Specifications Nos. 847,947, 941,680, 972,832, and 976,602.

However, all the proteases used in these processes have the disadvantage that either the pickling or softening effect is inadequate, or a certain amount of loosening of the hair has to be accepted. Thus, the above-mentioned patent specifications recommend working at acid pH values, or the joint use of carbohydrases, although this does not achieve the object in a really satisfactory manner. For this reason, German Offenlegungsschrift No. 16,69,353 describes a process for loosening the fibrous structure of furs in which the enzyme takes effect only after the tanning agent takes effect.

In accordance with German Patent Specification No. 18,00,891, the same enzymes are used for softening as are used for depilation, the enzyme concentrations being, of course, reduced by the factor 10 in the former field of application and the pH value being adjusted to 3 to 4. It is obvious that, under these conditions, either the risk of loss of the hair has to be accepted or an optimum softening effect has to be foregone.

DETAILED DESCRIPTION OF THE INVENTION

According to the present invention, the satisfactory softening of furs, or fur skins, particularly high-grade furs such as mink or Persian lamb, may be achieved while at the same time taking the greatest possible care of the appearance of the hair. The present invention is directed to a process for the enzymatic softening of furs, which comprises contacting a fur with an acid aqueous liquor containing an acid protease from a fungus strain of the genus *Rhizopus rhizopodiformis* (as hereinafter identified), said acid protease being effective in the pH range of from about 2.5 to 6.5.

The softening of the furs may also comprise contacting the fur with wetting agents and/or inorganic salts.

The acid protease from a fungus strain of the genus *Rhizopus rhizopodiformis* which is used in the process of the present invention has been filed at the Central Bureau voor Schimmelcultures, Baarn, Holland, and has been given the filing number CBS 227.75.

In accordance with U.S. Pat. No. 4,062,732, incorporated herein by reference, the protease used having the Filing Number CBS 227.75 (Central Bureau voor Schimmelcultures, Baarn, Holland), is obtained by the anaerobic culture of a fungus strain of the genus *Rhizopus rhizopodiformis* in a nutrient, which contains assimilable carbon and nitrogen sources, at pH values between 3 and 7 and temperatures between 25° and 50° C., and, in a known manner, separating out the enzyme produced. The enzyme has a wide spectrum of activity in the slightly acid pH range of from about 2.5 to 6.5, with an optimum activity at the pH range of from about 4.5 to 5.2.

The proteolytic activity of the present protease is determined by the known Anson principle, whereby a suitably diluted quantity of enzyme solution is incubated for twenty minutes at 40° C. with an equal volume of 1.2% casein solution, the latter containing 0.6% of lactic acid, 6 mol of urea, and 0.1 mol of citric or acetic acid. The pH value of the casein solution is adjusted to 4.5 by adding 2 N caustic soda solution. After incubation, 0.4 N trichloroacetic acid is added in the volume ratio of 1:1, the precipitate of undigested casein which is formed is filtered off, and the protein fragments produced during degradation are determined in the filtrate by any desirable method of determining protein. By way of example, the method described by Layne in *Methods of Enzymology,* 3 (1957), pages 448 ff., incorporated herein by reference, is suitable for this purpose.

A blank value, in which trichloroacetic acid and then casein solution are added, has to be prepared for each measuring experiment. In addition to the blank value of the reagents, this blank value gives the proportion of low molecular peptides present in the enzyme solution before digestion. In the methods specified, the difference between the main value and the blank value is then compared with the extinction which a specific quantity of tyrosine yields in this analysis. This quantity of tyrosine is then indicative of the proteolytic activity of the enzyme present: an enzyme unit (TU) is that quantity of enzyme which causes the same extinction difference between the main value and the blank value per minute as a 1 M tyrosine solution which is used instead of the enzyme solution.

It is readily possible to measure the proteolytic activity at pH values above and below 4.5 by suitable adjustment of the casein solution, although it is advantageous to substitute citric acid for the additive of acetic acid.

In the case of the present invention, the proteolytic activity in the softening liquor should be from about 5 to 100 mTU/liter. This corresponds to from about 0.005 to 0.05 g/l of an enzyme concentrate obtained in accordance with the data given above.

The special advantage of the enzyme used resides in its high proteolytic activity in a pH range of from about 3.5 to 6.0, preferably from about 4.5 to 5.2, favorable for the softening of furs, whereby the furs can be softened to an optimum extent with a relatively small dosage without adding carbohydrases. In particular, the protease is distinguished by a low content of collegenase-, elastase-, and keratinease activities, whereby the risk of loss of the hair is considerably reduced compared with former preparations.

In addition, the low content of amidase and exopeptidase activities of the enzyme used in the present invention preparation has a favorable effect on the loosening of the hair in that the denatured, agglutinating proteins are only partially hydrolyzed and dissolved out of the skin structure, whereby its original swelling capacity is restored, although, on the other hand, the regulating effect of these proteins on the water balance of the collagen fibers is not lost.

Furthermore, a fundamental advantage resides in the fact that the agents used in the present invention develop their optimum effect at a working pH value of from about 4.5 to 5.2, whereby there is no need to use acid and the risk of acid swelling is avoided. The alternative use of non-swelling, although more expensive, organic acids such as naphthalene sulfonic acid or oxyisobutyric acid, is also not necessary.

The preferably desired pH range of from about 4.5 to 5.2 is automatically adjusted when softening with an enzymatic softening agent when the softening liquor contains a relatively large amount of sodium bisulphite in addition to ammonium sulphate. In practice, from about 0.2 to 2 g/l of sodium bisulphite is used in addition to from about 0.05 to 0.5 g/l of ammonium sulphate, the quantity ratio being from about 2:1 to 4:1. The enzyme can be combined with the salts to form an enzymatic softening agent. A mixture of this kind comprises, for example, from about 65 to 80% of sodium bisulphite, from about 17 to 35% of ammonium sulphate, and from about 0.5 to 5% of enzyme. The mixture is used in quantities of from about 0.5 to 5 g/l of softening liquor. The liquor ratio (hide:softening liquor) is from about 1:15 to 1:30, and the liquor temperature is from about 10° to 40° C.

The softening action is intensified by the joint use of an approximately equal quantity of nonionic wetting agent such as the adduct of 9 mols of ethylene oxide to nonylphenol. Anionic wetting agents, particularly Na-$C_{12/18}$ - sulphosuccinate, are also suitable. Excellent softness and wad-like nature of the furs is thereby obtained in conjunction with the enzyme used in the present invention, with a more rapid softening process without the risk of loosening of the hairs. The wetting agents are normally used in a quantity of approximately 0.2 to 2 g/l.

To avoid any loss of the hair when treating high-grade furs, it may be advisable to perform the enzymatic softening process after a normal wetting agent softening and washing process in a conventional fur pickle in the presence of inorganic salts such as common salt and/or ammonium chloride. Quantities of from about 20 to 50 g/l of common salt and from about 2 to 10 g/l of ammonium chloride are normally used in the pickle. Adjustment to pH values of approximately 2.5 to 3 is effected by, for example, adding formic acid.

EXAMPLES

The present invention can be illustrated by the following examples and is not to be construed as being limited thereto.

EXAMPLE 1

Dried rabbit-skins were softened with 1 g/l of a mixture comprising:

77.4% of sodium bisulphite, anhydrous
21.5% of ammonium sulphite, anhydrous
1.1% of enzyme for approximately twenty hours at approximately 25° C. with a liquor ratio of 1:20. Satisfactorily swollen rabbit-skins were obtained which can be finished in a conventional manner.

EXAMPLE 2

Dried rabbit-skins were softened with 1 g/l of the mixture set forth in Example 1, and
1 g/l of nonylphenol -9 (EO=ethylene oxide)

for approximately 15 to 20 hours at 25° C. with a liquor ratio of 1:20. Satisfactorily swollen skins were obtained which can be further processed in a conventional manner.

EXAMPLE 3

Salted sheep-skins were softened with 0.5 g/l of the mixture set forth in Example 1, and
0.5 g/l of a sulphosuccinate for approximately fifteen hours at approximately 25° C. with a liquor ratio of 1:20. The skins, which swelled in a particularly satisfactory manner and, were further processed in a conventional manner, a particularly soft, wad-like feel being produced after tanning.

EXAMPLE 4

Air-dried mink pelts were softened in a conventional manner with a wetting agent softener, washed, and treated for six hours at 30° C. with 30 g/l of common salt
5 g/l of ammonium chloride
1 to 2 g/l of the mixture in accordance with Example 1.

They were subsequently pickled overnight with an addition of 40 g/l of common salt
5 to 8 g/l of 85% formic acid and finished in a conventional manner. A particularly softened mink fur was therby obtained, without the risk of loss of the hair.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A process for the enzymatic softening of furs, which comprises contacting a fur with an acid aqueous liquor containing an acid protease from a fungus strain of the genus *Rhizopus rhizopodiformis*, said acid protease being effective in the pH range of from about 2.5 to 6.5.

2. The process of claim 1, in which the enzymatic activity in the liquor is from about 5 to 100 mTU/liter.

3. The process of claim 1, in which the enzymatic softening is performed at a pH of from about 3.5 to 6.0.

4. The process of claim 3, in which the enzymatic softening is performed at a pH of from about 4.5 to 5.2.

5. The process of claim 1, which also comprises contacting the fur with a wetting agent and/or inorganic salt.

6. The process of claim 1, in which the fur is a high-grade fur and the enzymatic softening is performed at a pH of from about 2.5 to 3 and after a wetting agent softening in a fur pickle.

7. In a process for the enzymatic softening of furs by contacting a fur with an acid aqueous liquor containing an acid protease, the improvement which comprises using an acid protease from a fungus strain of the genus *Rhizopus rhizopodiformis*, said acid protease being effective in the pH range of from about 2.5 to 6.5.

* * * * *